US010189665B2

(12) United States Patent
Acciari

(10) Patent No.: US 10,189,665 B2
(45) **Date of Patent: *Jan. 29, 2019**

(54) UNWINDER OF REELS OF WEB MATERIAL

(71) Applicant: A.CELLI NONWOVENS S.P.A., Porcari (LU) (IT)

(72) Inventor: Giuseppe Acciari, Porcari (IT)

(73) Assignee: A.CELLI NONWOVENS S.P.A., Porcari, (LU) (IT)

( * ) Notice: Subject to any disclaimer, the term of this patent is extended or adjusted under 35 U.S.C. 154(b) by 70 days.

This patent is subject to a terminal disclaimer.

(21) Appl. No.: 15/380,291

(22) Filed: Dec. 15, 2016

(65) Prior Publication Data

US 2017/0096312 A1 Apr. 6, 2017

Related U.S. Application Data

(63) Continuation of application No. 14/369,434, filed as application No. PCT/IB2012/057736 on Dec. 27, 2012, now Pat. No. 9,550,644.

(30) Foreign Application Priority Data

Dec. 29, 2011 (IT) ..... FI2011A0277

(51) Int. Cl.
*B65H 19/12* (2006.01)
*B65H 23/182* (2006.01)
(Continued)

(52) U.S. Cl.
CPC ..... *B65H 19/12* (2013.01); *B65H 16/06* (2013.01); *B65H 16/103* (2013.01); *B65H 19/102* (2013.01); *B65H 19/1815* (2013.01); *B65H 19/1863* (2013.01); *B65H 23/1825* (2013.01); *B65H 2301/41361* (2013.01); *B65H 2301/41734* (2013.01); *B65H 2301/415085* (2013.01); *B65H 2301/4641* (2013.01); *B65H 2301/46171* (2013.01); *B65H 2301/46312* (2013.01); *B65H 2401/14* (2013.01); *B65H 2403/20* (2013.01);
(Continued)

(58) Field of Classification Search
CPC ..... B65H 19/12; B65H 19/102; B65H 16/06; B65H 16/103
See application file for complete search history.

(56) References Cited

U.S. PATENT DOCUMENTS 5,779,184 A * 7/1998 Kaufmann ..... B65H 19/1821 226/195
6,719,240 B2 * 4/2004 Hanson ..... B65H 16/103 242/554.6

(Continued)

*Primary Examiner* — Sang K Kim
(74) *Attorney, Agent, or Firm* — McGlew and Tuttle, P.C.

(57) ABSTRACT

An unwinder of reels of web material wound around winding spindles (A), includes a unwinding station (13) with at least one unwinding member (23) to rotate a reel (B) that is located in the unwinding station and feed the web material toward a delivery path (E). Lifting members (51, 53) are provided to lift a spindle of a first exhausted reel from the unwinding station (13), in a removal position (PR). An insertion member (7; 33) is further provided to insert a second reel into the unwinding station (13). A pressing member (61) is arranged to press the web material coming from the first reel in removal position (PR) against the second reel in the unwinding station (13).

21 Claims, 8 Drawing Sheets

(51) Int. Cl.

| | |
|---|---|
| ***B65H 19/18*** | (2006.01) |
| ***B65H 16/06*** | (2006.01) |
| ***B65H 16/10*** | (2006.01) |
| ***B65H 19/10*** | (2006.01) |

(52) U.S. Cl.
CPC .... *B65H 2408/24* (2013.01); *B65H 2511/212* (2013.01)

(56) References Cited

U.S. PATENT DOCUMENTS

| | | | | |
|---|---|---|---|---|
| 7,350,740 | B2 * | 4/2008 | Benvenuti | B65H 19/126 242/555.1 |
| 7,950,602 | B2 * | 5/2011 | Petri | B65H 16/06 242/559 |
| 9,550,644 | B2 * | 1/2017 | Acciari | B65H 23/1825 |
| 2004/0118964 | A1 * | 6/2004 | Long | B65H 19/126 242/554.2 |

* cited by examiner

IA
1
3
5
7
9
11
13
15
17
19
21
23
25
25A
27
29
30
31
33
35
37
39
41
43
45
47
51
53
55
55A
57
59
60
60A
60B
61
63
65
66
71
73
75
77
79
81
B
E
N
f51
f55
f63
f73
f39
f29

1
3
5
7
23
25
25A
27
29
30
31
35
37
51
53
55
55A
57
59
60
60A
61
63
71
73
75
77
79
81
101
103
105
107
109
109A
A1
A2
B
E
f55
f105
PR
N

UNWINDER OF REELS OF WEB MATERIAL

CROSS REFERENCE TO RELATED APPLICATIONS

This application is a continuation under 37 CFR 1.53(b) of pending prior application Ser. No. 14/369,434 filed Jun. 27, 2014 and claims the benefit (35 U.S.C. § 120 and 365(c) of International Application PCT/IB2012/057736 filed Dec. 27, 2012, which designated inter alia the United States and which claims the priority of Italian Patent Application FI2011A000277 of Dec. 29, 2011. The entire contents of each application is hereby incorporated by reference in its entirety.

FIELD OF THE INVENTION

The present invention relates to machines for converting web materials and more particularly unwinders for unwinding master rolls or parent reels of web material to feed a converting machine downstream, such as a rewinder.

BACKGROUND OF THE INVENTION

In the field of manufacturing articles made of non-woven, paper or similar web materials, machines are used to manufacture master rolls or reels of large diameter, for example at the outlet of a web material manufacturing machine. The reels or master rolls are formed by winding the web material around a winding spindle.

The reel is then inserted in an unwinder to be unwound and to feed the web material in a substantially continuous manner to a converting line downstream.

When the reel is exhausted or almost exhausted, it must be replaced with a new reel. For this purpose, the machine is normally stopped and the spindle on which the exhausted or almost exhausted reel was wound is removed from the unwinding station and replaced with a new reel. These operations are normally managed manually. Manual execution of the changeover cycle of the exhausted reel with a new reel takes a relatively long time which cannot be estimated, as it depends very much on the operator's skill. This causes drawbacks on the conversion line downstream. For example, if an accumulator of the web material is provided between the unwinder and the rewinder, the quantity of material accumulated in the accumulator may be insufficient to continuously feed the rewinder downstream if the time to replace the exhausted reel with the new reel is longer than it should be, for example due to inexperience or lack of promptness of the operator or due to the fact that the operator must dedicate attention to more urgent operations, putting on hold or slowing down the operations to replace the exhausted reel with the new reel.

EP-A-732287 describes an automatic unwinder, in which splicing between the web material of a first almost exhausted reel and the web material of a new reel takes place when both the reels are rotating and have an identical peripheral speed. For this purpose, two unwinding members are provided, one in a first unwinding station and one in a second unwinding station. A roller is moved rapidly to perform splicing of the two web materials when the first reel is almost exhausted. This prior art device is made complex by the need to use two distinct unwinding members and a speed synchronization system to perform splicing. Moreover, it can only unwind reels wound in one direction and not reels wound in the other direction, for example only reels wound clockwise, but not counter-clockwise, or vice versa.

SUMMARY OF THE INVENTION

The present invention relates to an unwinder for web material, in particular but not exclusively for a non-woven material, which fully or partly overcomes one or more of the drawbacks of the prior art.

Substantially, according to one embodiment, a reel unwinder is provided, comprising an unwinding station with at least one unwinding member to rotate a reel that is located in said unwinding station and feed the web material toward a delivery path. The unwinder comprises lifting members, for example in the form of (preferably pivoting) lifting arms to lift a spindle of a first exhausted reel from the unwinding station toward a removal position. Moreover, in some embodiments an insertion member is provided to insert a second reel into the unwinding station. Advantageously, a pressing member can be arranged and controlled to press the web material coming from the first reel arranged in the removal position against the second reel in the unwinding station, so as to perform splicing between the web materials of the two reels and allow the material coming from the reel in the final stage of unwinding to be drawn by friction. In this way, there is no need to provide two unwinding stations, each provided with its own unwinding members. On the contrary, the unwinder described here has a single unwinding station with unwinding members, preferably of peripheral type, for example with belts. The second position, in which the exhausted reel to be replaced is transferred to clear the unwinding station, is not an unwinding station, with its own unwinding members, but an area for the removal and temporary standby of the exhausted reel. Transfer of the reel from the unwinding station to the removal station can take place with the reel substantially non-rotating, thus interrupting unwinding of the web material. Transferring the reel from the unwinding station to the removal station generates a portion of web material that extends from the exhausted reel located in the removal position to the unwinding station. Splicing to the web material coming from the new reel inserted into the unwinding station takes place along this portion of residual material connected to the exhausted reel. This ensures the continuity of the web material along the unwinding and delivery path towards the line fed by the unwinder. Therefore, it is not necessary to draw the web material into the feed path again at each reel change. This result is obtained with a particularly simple structure, which requires a single unwinding system or unwinding member.

Moreover, as will be clear from the following description of some embodiments, with this arrangement it is possible to use the same unwinder to unwind both reels wound clockwise and reels wound counter-clockwise.

A configuration of this type allows automation of the cycle to replace a first reel in the final stage of unwinding with a new reel which has been arranged in a standby position. The reel in the standby position can be provided with a double-sided adhesive tape and can be positioned in the correct angular position to subsequently perform automatic splicing to the tailor end part of the web material coming from the first reel, in the final stage of unwinding, which is in the removal position. In the standby position means can be provided for slow rotation of the reel, for example an electric motor that controls a central or peripheral rotation system of the reel, to prevent out-of-roundness thereof during the standby time.

To facilitate severing or interrupting of the web material coming from the exhausted reel, located in the removal position, in some embodiments a braking system is associated with the lifting members that transfer the reel from the unwinding station to the removal position, to brake the spindle of the reel located in the removal position and therefore to tension the section of web material between the reel in the final stage of unwinding and the splicing area, tangentially to the second reel located in the unwinding station. A severing or interruption member acts along this portion of the web material, tensioned due to the braking of the spindle of the exhausted reel, giving rise to more precise severing.

To obtain more rapid splicing between the material of the second reel positioned in the unwinding station and the first exhausted reel, transferred to the removal position, the new reel can advantageously be angularly positioned before being transferred to the unwinding station, so that the leading edge or in any case the splicing area of the web material is optimally positioned. This is particularly advantageous when the unwinding station has peripheral unwinding members, for example unwinding belts that act on the outer surface of the new reel. In this case, it is advantageous for the point in which splicing is carried out, and in which a double-sided adhesive tape is normally arranged, to be positioned so that it does not come into contact with the peripheral unwinding member, to prevent the double-sided adhesive tape (or other joining means of the two web materials) from coming into contact with the unwinding member. In practice, the angular position of the reel is such that when it starts rotating the splicing area comes into contact with the web material coming from the exhausted reel and adheres thereto, instead of touching the unwinding member.

For this purpose, it can be advantageous for the unwinder to have a positioning and standby area of the reels to be unwound, in which members for rotation or angular positioning of the reels standing by are provided. These rotation members can aid the operator in angularly positioning the reel and in arranging it with the double-sided adhesive tape or other system for splicing to the exhausted reel. In particularly advantageous embodiments, the rotation members can also be used to rotate the reel standing by, to prevent out-of-roundness deformation thereof due to its weight.

In advantageous embodiments, an angular positioning device of the reels is also provided, i.e. a device to aid the operator, by means of which the operator can easily identify the position in which reel must be located to arrange it with the double-sided adhesive tape in the correct angular position to perform splicing with the web material in the final stage of unwinding coming from the reel in the removal position.

In some embodiments, the unwinder also comprises transfer members, to transfer a reel from the standby area to the unwinding station with a movement of translation without rotation, to prevent modification of the angular position of the reel and ensure that, after reaching the desired angular position and arranging the double-sided adhesive tape for splicing to the web material coming from the exhausted reel, the angular position of the positioned reel is not accidentally lost during transfer to the unwinding station. These transfer members can comprise a pair of carriages that translate the spindle on which the reel is wound. The spindle can have annular supports mounted on the spindle and adapted to idly rotate with respect to the spindle. The annular supports can rest on rolling guides. When the spindle of the reel is translated by the carriages, it does not rotate, while the annular supports roll on the guides extending from the standby area toward the unwinding station. The annular supports can be rolling bearings.

According to a further aspect, a method is disclosed, for replacing a first reel in the final stage of unwinding with a second reel in an unwinder of reels of web material wound around winding spindles, comprising the steps of:

- interrupting or slowing down unwinding of a first reel located in an unwinding station;
- lifting the first reel in the final stage of unwinding and the respective winding spindle from the unwinding station in a removal position, forming a portion of web material between the first reel in the removal position and a delivery path;
- inserting a second reel in the unwinding station, said second reel having a leading edge of web material, whereon a double-sided adhesive material has been applied;
- pressing, by means of a pressing member, the web material of the first reel against the outer surface of the second reel during rotation of the second reel;
- starting rotation of the second reel thus unwinding by pulling the web material of the first reel in the removal position until said web material adheres to a leading edge of the second reel by means of said double-sided adhesive material;
- interrupting with a severing member the web material between the first reel in removal position and the point of adhesion to the leading edge of the second reel.

The initial rotation of the second reel can be in the unwinding direction, or in the opposite direction. In the second case, after splicing of the web materials coming from the two reels, the exhausted reel and the new reel, the direction of rotation is reversed, to start unwinding of the new reel located in the unwinding station.

In order to unwind by pulling the web material of the first reel in the final stage of unwinding located in the removal position, a pressure member is advantageously provided, for example a preferably idle pressing roller, which presses the web material of the first reel against the lateral surface of the second reel. This on the one hand generates friction which draws the residual web material from the first reel, and on the other hand provides sufficient pressure to cause adhesion of the web material of the first reel in the final stage of unwinding to the web material of the second reel by means of a double-sided adhesive tape interposed between the two web materials, and which was applied previously to the second reel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 1A:
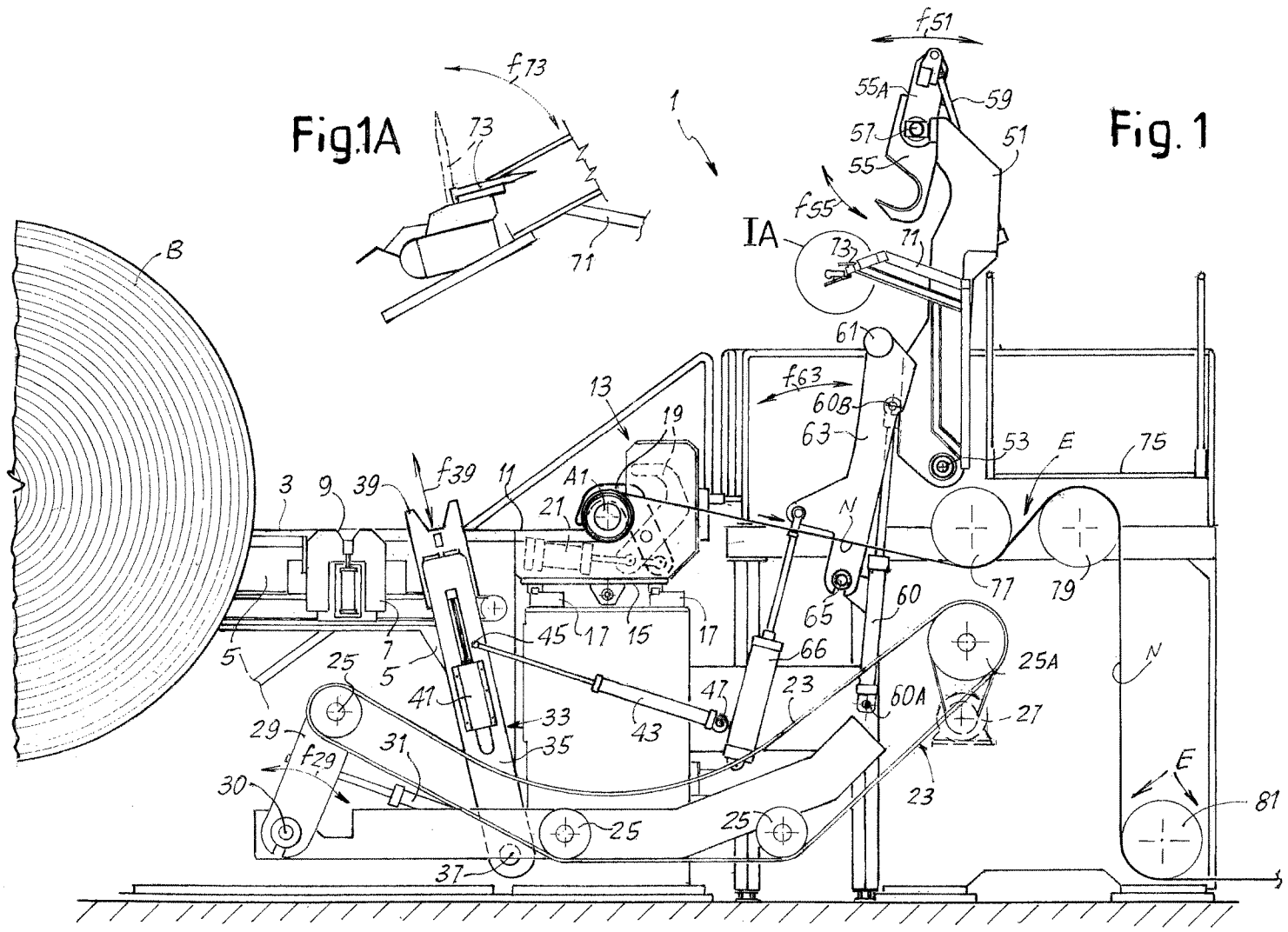
FIG. 1 is a view showing the main elements of the unwinder and a part of an operating sequence to change an exhausted reel with a new reel.
FIG. 1A is an enlarged view of a severing member of web material.

The unwinder illustrated in the accompanying drawings is indicated as a whole with 1. At the inlet of the unwinder rails 3 are provided for advancing the reels or master rolls B from a preparation and standby station, described below with reference to FIGS. 10 to 12. The rails 3 are provided on the side members 5, inside which carriages 7 translate, one on each side member, controlled by an appropriate movement system, for example a chain, not described in greater detail. Each carriage 7 has a cradle 9 which engages a respective end shank of the winding spindles A on which the reels B are formed.

Figure 7:
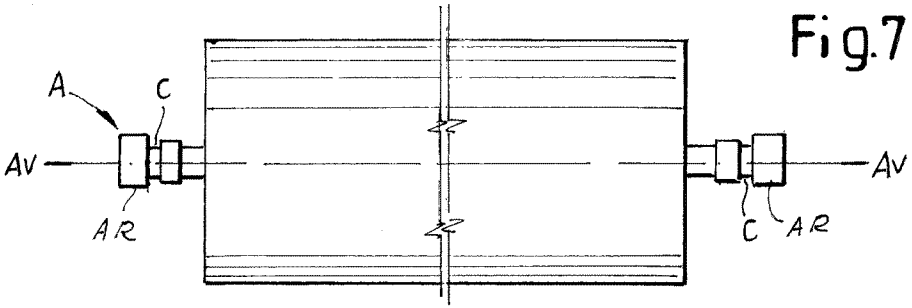
FIG. 7 is a schematic side view of a reel or master roll with the respective winding spindle.

As can be seen in particular in FIG. 7, each spindle A projects from the respective reel B formed thereon with two ends or shanks on which rolling bearings C are arranged to allow the spindle A to be engaged and translated along the rails 3 by means of the carriages 7 without rotating the reel B around the winding axis AV-AV thereof. As will be described in greater detail below, this allows angular positioning of the free edge or leading edge of each reel B in a suitable angular position when the reel in the preparation and standby station upstream of the unwinder and the angular position of the initial free edge to be maintained until the reel has been positioned in an unwinding station 13 of the unwinder 1.

The rails 3 are substantially aligned with respective support surfaces 11 arranged in the unwinding station 13 of the unwinder 1. The support surfaces 11 can translate orthogonally to the rails 3, with respect to the side members 5, so as to axially adjust the position of each reel B that is located in the unwinding station 13.

To allow the transverse movement of the support surfaces 11, these are carried by respective slides 15 sliding along guides 17. The sliding movement of the slides 15 on the guides 17 is controlled by an appropriate motor, for example an electric motor, by means of a threaded rod and nut system or the like for each support surface 11. The translation movements of the two support surfaces 11 are synchronized with each other, for example by means of an electronic control unit of the unwinder 1.

Retaining members, associated with each slide 15, are provided in the unwinding station 13 to retain the reel located in the unwinding station 13. In some embodiments the retaining members comprise, for each side of the unwinder, a hook member 19 controlled by a piston-cylinder actuator 21. Retaining members of different shape can also be provided, for example designed to engage the spindle of the reel axially instead of around the spindle.

Moreover, an unwinding member 23 is provided in the unwinding station 13. In the embodiment illustrated, the unwinding member 23 comprises a plurality of unwinding belts forming as a whole an endless flexible element, guided around a plurality of guide rollers, generically indicated with 25, one of which, indicated with 25A, is motorized, for example by means of a motor 27. The path of the unwinding member 23 defined by the rollers 25, 25A can be modified to maintain the unwinding member 23 tensioned as the diameter of the reel B located in the unwinding station 13 decreases as a result of delivery of the web material toward a station downstream, through a delivery path indicated as a whole with E. In the embodiment illustrated, for this purpose at least one of the rollers 25 is mounted on a system of moving arms 29 pivoted in 30 to pivot according to the double arrow f29 under the control of a piston-cylinder actuator 31 or the like, in order to maintain the unwinding member 23 in tension.

It must be understood that in actual fact each roller 25 can be formed by a plurality of coaxial wheels or pulleys, optionally carried by a common shaft. For example, a pulley or wheel can be provided for each belt forming the flexible unwinding member 23. The motorized roller 25A can, for example, be formed by a plurality of wheels or pulleys fitted on a common motor shaft.

To move the reel B from the rails 3 to the support surfaces 11, in the embodiment illustrated, an insertion member 33 is arranged between the side members 5. In the embodiment illustrated, the insertion member 33 comprises arms 35 pivoting around a pivot axis 37 constrained to the fixed structure of the unwinder 1. In the drawing, only one of the arms 35 is visible, said arms being superimposed one on the other in the side view. The arms 35 allow transfer of the reels by translation without rotation, so that when these latter have been prepared with a double-sided adhesive tape appropriately positioned angularly to perform splicing to the web material of the reel in the final stage of unwinding, the angular position is maintained also during transfer of the reel in the unwinding station.

In the example illustrated, each pivoting arm 35 is adjacent to and inside the respective side member 5. In the example illustrated, each pivoting arm 35 carries a respective pick-up element 39, for example U-shaped, to form a cradle for engagement of the respective ends of the winding spindle A of the reel B which must be transferred from the angular positioning station to the unwinding station 13. The pick-up member 39 of each pivoting arm 35 can be controlled by means of a piston-cylinder actuator 41 to move according to the double arrow f39 in order to engage and disengage the spindle.

By means of the insertion member 33 it is therefore possible to pick up each reel B from the carriages 9 and transfer it from the pair of rails 3 to the support surfaces 11. This allows the support surfaces 11 to be separated from the rails 3 so that they can be made movable crosswise with respect to the longitudinal extension of the rails 3. In fact, the moving carriages 9 perform a movement along the rails 3 to the end of the same rails, but do not allow transfer of the reel onto the support surfaces 11, which can therefore assume an offset position with respect to the rails 3. In other embodiments, the support surfaces 11 can be omitted and the rails 3 can be extended to the unwinding station. In this case, the reels are transferred from the preparation and standby position to the unwinding station directly by the moving carriages 9.

The pivoting movement of the two arms 35 can be controlled, for example, by a piston-cylinder actuator 43, the rod whereof is constrained in 45 to the respective arm 35 and the cylinder whereof is pivoted in 47 to the fixed structure of the unwinder 1. A single piston-cylinder actuator 43 can be provided for both arms 35, and a torsion bar can be provided to connect the two arms torsionally to each other. In other embodiments, a piston-cylinder actuator 43 can be provided for each arm 35. Also in this case the arms can be connected to each other by a torsion bar to ensure the pivoting movement of the two arms is simultaneous.

In the illustrated embodiment the unwinder 1 also comprises a pair of arms 51, only one whereof is visible in FIGS. 1 to 6, pivoted in 53 to the fixed structure of the unwinder 1. The arms 51 are advantageously arranged on the two sides or side members of the unwinder 1. The two arms 51 are each provided with a respective hook 55. These hooks 55 are used to engage the ends of each winding spindle located in the unwinding station 13 and to lift it in the manner described below, from the unwinding station 13 toward a removal position PR above, i.e. located at a greater height with respect to the unwinding station 13. The removal position PR can be offset laterally with respect to the unwinding station 13, i.e. in general not vertically superimposed on the unwinding station 13. Lifting of the reel in the final stage of unwinding can also be obtained with lifting members different from the pivoting arms 51, for example with a system of slides carrying the hooks 55 or other members to engage the ends of the spindle to be lifted.

The hooks 55 are pivoted in 57 to the respective arms 51 and can pivot according to the double arrow f55 around the pivot 57 by means of a respective actuator, for example a piston-cylinder actuator 59 constrained at one end to the respective arm 51 and at the opposite end to the corresponding hook 55 or more precisely to an appendage 55A provided on each hook 55. The pivoting movement controlled by the actuator 59 on the one side allows the spindles of the exhausted reels to be picked up in the unwinding station 13 and on the other allows the spindles to be positioned so that they can be picked up easily by a bridge crane positioned over the unwinder 1, not shown in the figures.

The arms 51 can pivot according to the double arrow f51 around the axis 53 under the control of a piston-cylinder actuator 60 constrained in 60A to the fixed structure of the unwinder 1 and in 60B to the respective arm 51. The actuator 60 can be single, in which case a torsion bar can be provided to transmit motion from one to the other of the two arms 51. Alternatively, a double actuator 60 can be provided, for example a piston-cylinder actuator for each pivoting arm 51, optionally in combination with a torsion bar to ensure synchronism of movement of the two pivoting arms 51.

The unwinder 1 also comprises a pressing member 61, which in the example illustrated comprises an idle roller supported at its ends by pivoting arms 63. The pivoting arms 63 are pivoted in 65 to the fixed structure of the unwinder 1. Only one of the pivoting arms 63 is visible in the drawing.

The arms 63 pivoted in 65 to the fixed structure of the unwinder 1 are provided with a pivoting movement according to f63 controlled by a piston-cylinder actuator 66 or by a pair of piston-cylinder actuators 66. Also in this case, a torsion bar can be provided to join the two arms 63, to transmit motion from one to the other of these arms when a single piston-cylinder actuator 66 is used, or to ensure synchronism of movement of the two arms when two piston-cylinder actuators 66 are used for the two arms 63.

In the position of FIG. 1, both the arms 63 with the roller 61 forming the pressing member and the arms 51 with the hooks 55 are in the rest position, i.e. spaced from the unwinding station 13. In this arrangement, in an intermediate position between the pressing member 61 and the hooks 55 a support 71 is provided, which carries at its end a blade 73 movable according to the double arrow f73, as illustrated in greater detail in the enlargement of FIG. 1A.

Adjacent to the position of the hooks 55 in the arrangement of FIG. 1, the unwinder 1 is advantageously provided with a walkway 75 which can be reached by an operator to access a spindle retained by the hooks 55 for the purposes that will be explained in greater detail below.

The delivery path E of the web material N delivered from the reel B located in the unwinding station 13 is defined, in the initial part thereof, by two rollers 77 and 79 appropriately motorized, and by a third roller 81.

Operation of the unwinder 1 described above will now be illustrated with reference to the sequence FIGS. 1 to 6.

In FIG. 1 a first winding spindle, indicated with A1, on which a residue of a first reel from which a web material N is delivered toward the delivery path E, is present in the unwinding station 13. The winding spindle A1 must be removed from the unwinding station 13 and replaced by a second reel B wound around a second winding spindle, which is standing by.

Figure 2:
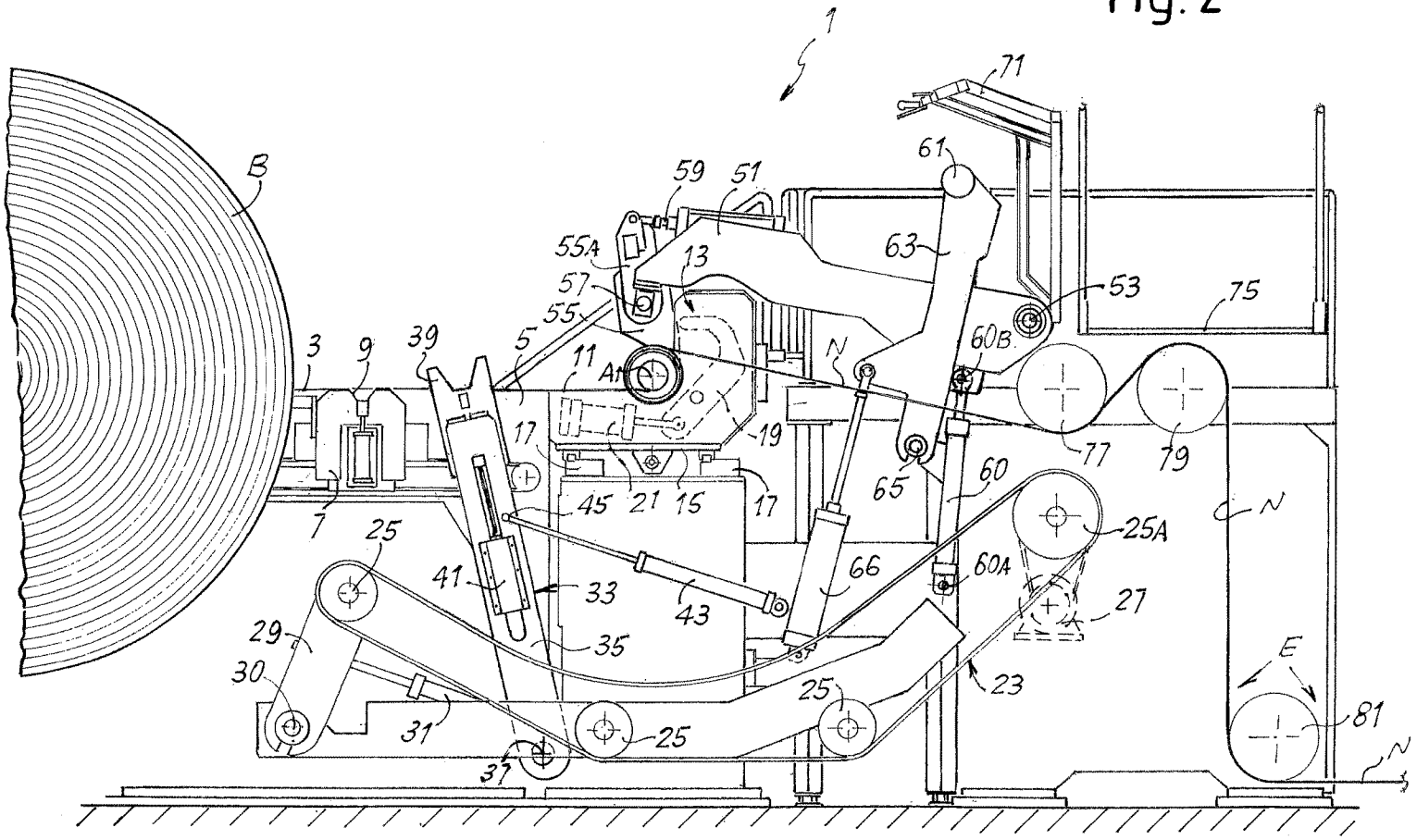
FIG. 2 is a view showing the main elements of the unwinder and another part of the operating sequence to change the exhausted reel with the new reel.

In FIG. 2 the arms 51 are lowered and the hooks 55 have been pivoted around the axis 57 so as to engage, at the related end shanks C, the spindle A1 located in the unwinding station 13. In this step delivery of the web material N from the reel in the final stage of unwinding is preferably interrupted.

Figure 3:
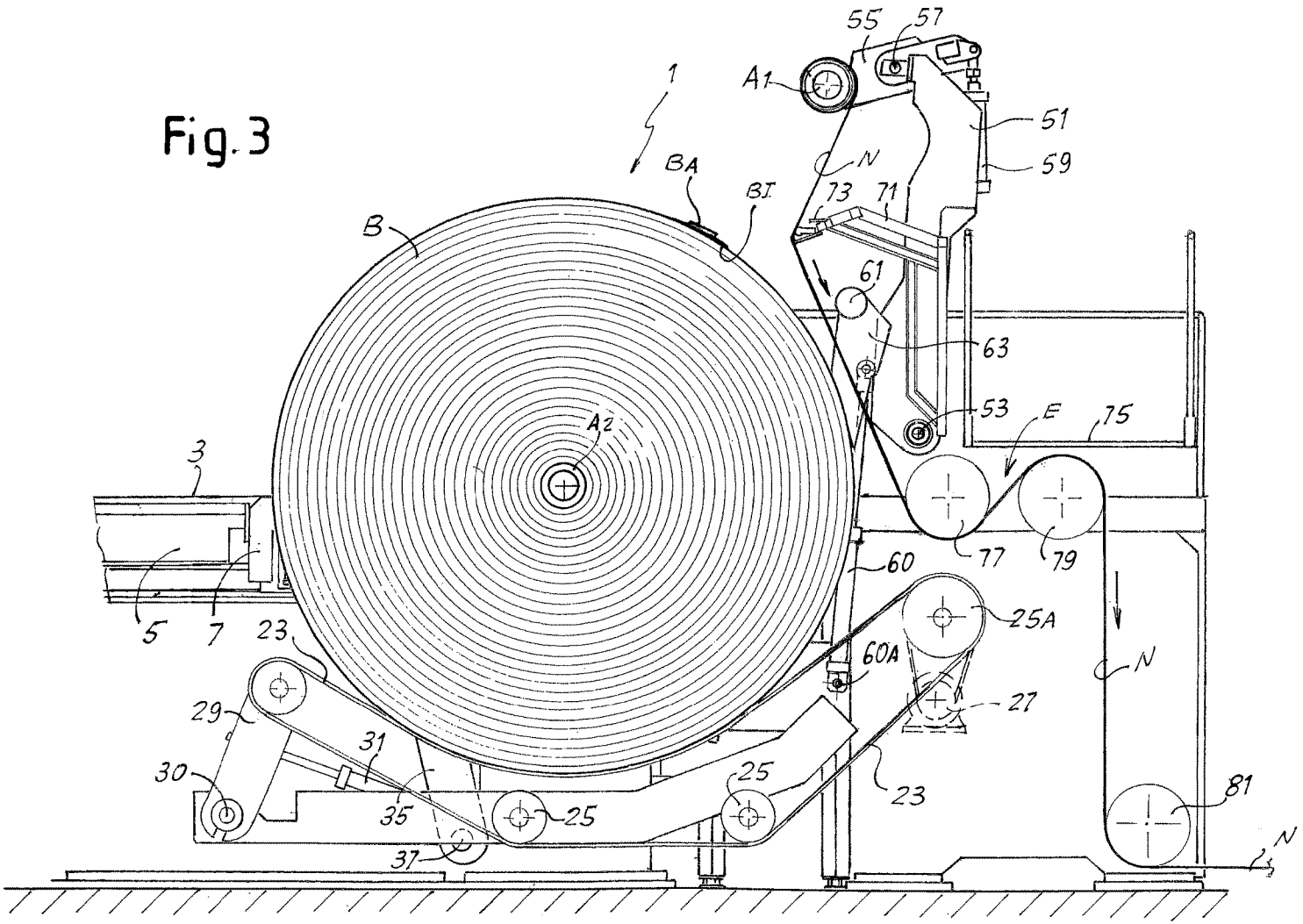
FIG. 3 is a view showing the main elements of the unwinder and yet another part of the operating sequence to change the exhausted reel with the new reel.
Figure 4:
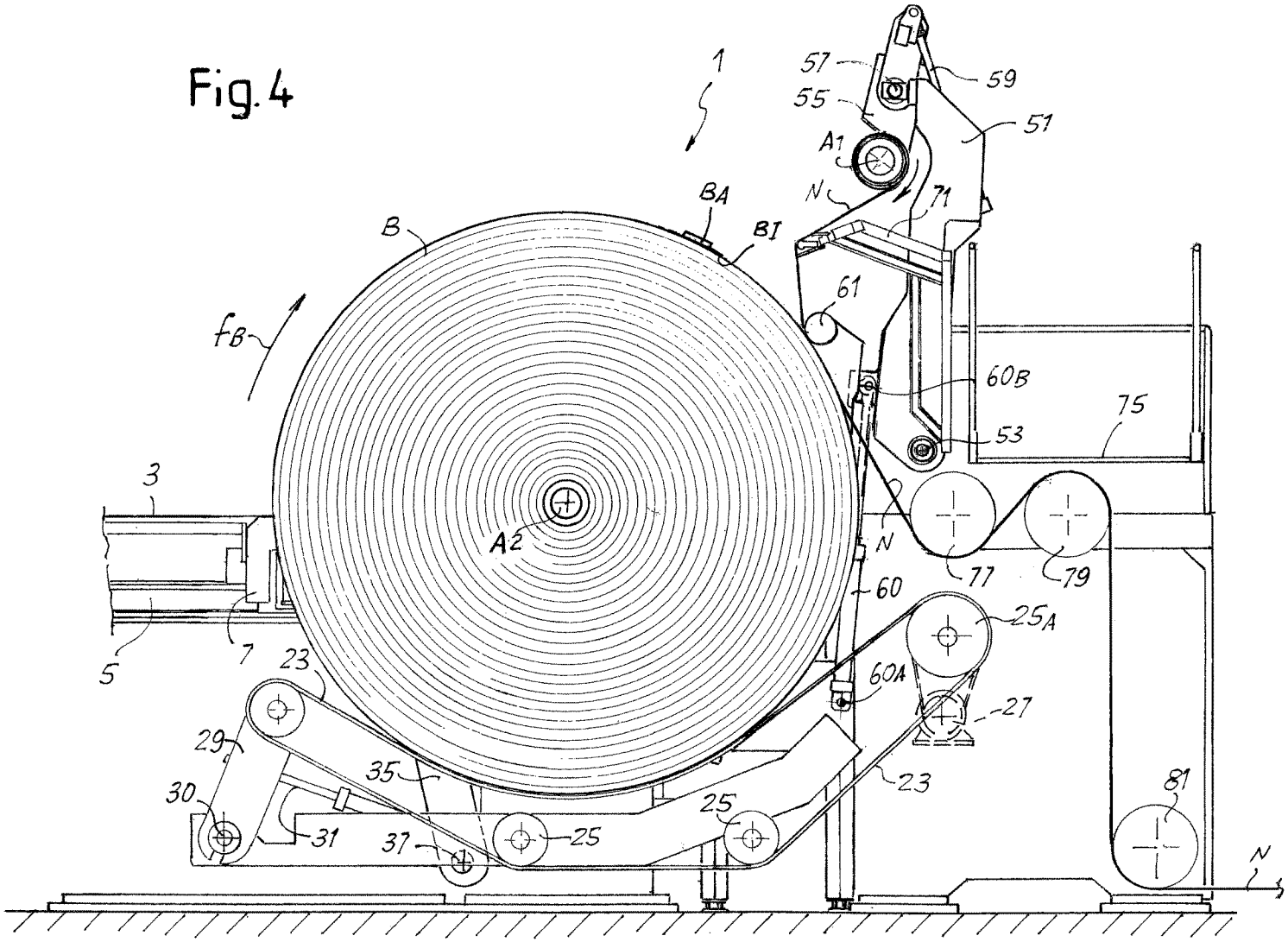
FIG. 4 is a view showing the main elements of the unwinder and yet another part of an operating sequence to change the exhausted reel with the new reel.
Figure 5:
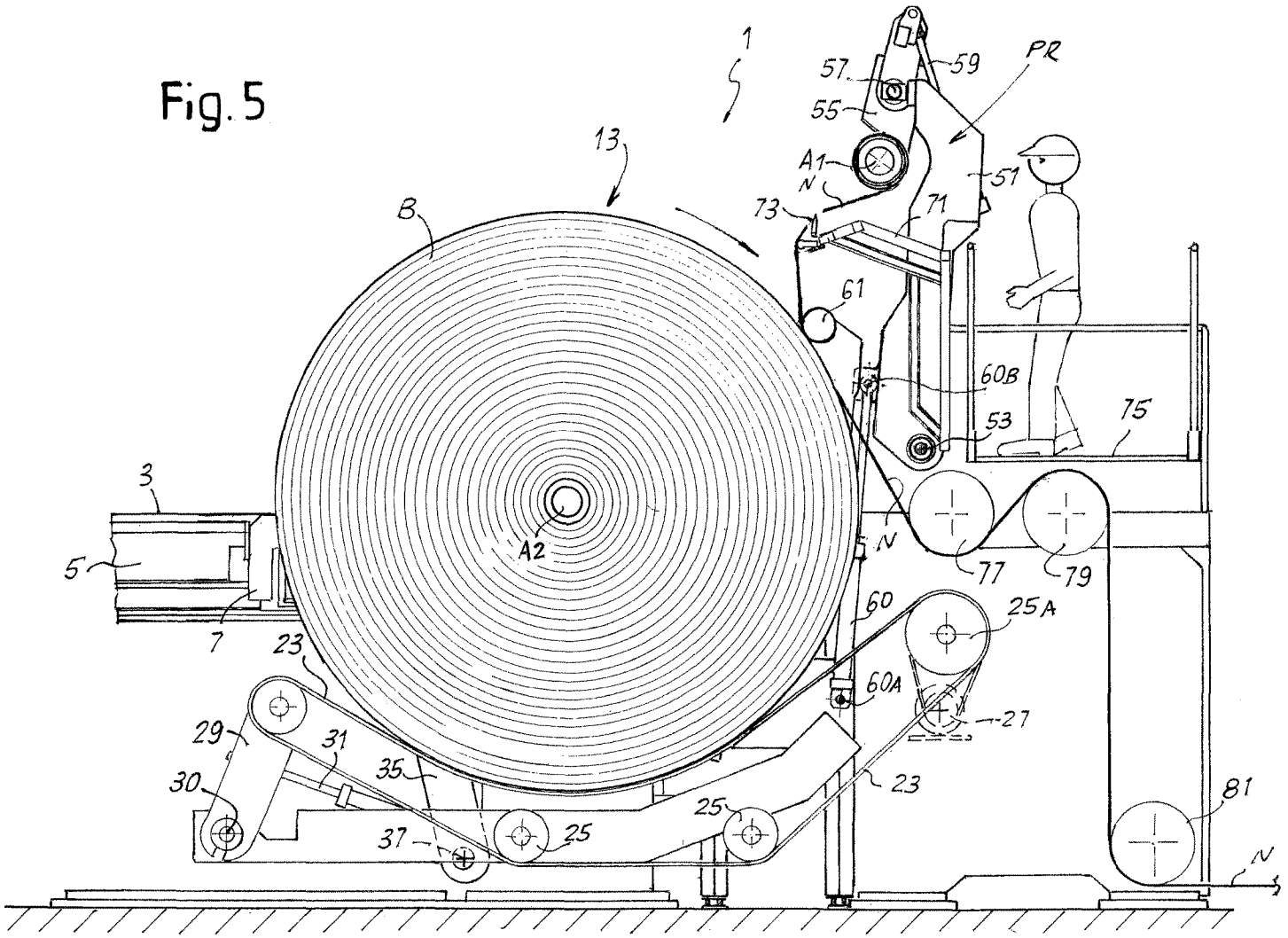
FIG. 5 is a view showing the main elements of the unwinder and yet another part of an operating sequence to change the exhausted reel with the new reel.

In FIG. 3 the reel B has been transferred by the carriages 7 toward the unwinding station 13 and inserted therein through a pivoting movement of the arms 35 controlled by the actuator 43.

To allow insertion of the second reel B, which is wound around a second winding spindle A2, the first winding spindle A1, with the residue of the first reel, previously located in the unwinding station 13, has been lifted by means of a lifting movement of the arms 51. The web material N delivered by the first exhausted reel formed around the first winding spindle A1 is unwound during lifting of the first winding spindle A1 from the unwinding station to the removal position PR. In this way a portion of web material N is formed, which extends from the removal position PR, to which the first unwinding spindle A1 has been carried, to around the roller 77, therefore in contact with the cylindrical surface of the new, second reel B, inserted in the unwinding station 13.

A piece or a series of pieces of double-sided adhesive tape BA has been previously applied to, or in the vicinity of, the leading edge BI of the web material forming the reel B. The leading edge BI has been fixed on the cylindrical outer surface of the reel B by means of adhesive tape which is less adherent than the double-sided adhesive tape BA, so as to allow detachment of the leading edge BI when unwinding of the reel starts. The angular position in which the leading edge BI is located and therefore in which the piece or series of pieces of double-sided adhesive tape BA is also located is chosen appropriately to allow the subsequent splicing step of the web material N coming from the reel in the final stage of unwinding around the spindle A1 to the web material of the reel B to be performed correctly, with an operating sequence described below.

To perform splicing, in the subsequent step (FIG. 4) the pressing member formed by the roller 61 is moved against the cylindrical surface of the reel B pressing the web material N coming from the first winding spindle A1, located in the removal position PR, against the cylindrical outer surface of the reel B in the unwinding station 13.

The reel B starts to rotate as a result of activation of the movement of the unwinding member 23. The direction of rotation of the reel B is indicated with fB. Consequently, the double-sided adhesive tape BA applied in proximity of, or to the leading edge BI of the web material of the reel B moves gradually toward the pressure area of the pressing member 61 and passes thereunder, remaining between the cylindrical surface of the reel B and the web material N coming from the residue of the first reel wound on the first winding spindle A1 located in the removal position PR. Rotation of the reel B and the pressure exerted by the pressing member 61 cause the first winding spindle A1 also to be drawn in rotation to deliver by pulling the web material N remaining around the first winding spindle A1.

As the rotating movement continues, the web material N of the reel in the final stage of unwinding adheres by means of the double-sided adhesive tape BA to the leading edge BI of the web material wound on the second reel B. Once mutual adhesion has been obtained between the web material N coming from the first winding spindle A1 and the web material of the reel B in the unwinding station 13, the web material N can be severed. For this purpose the blade 73 is extracted until it interferes with the trajectory of the web material N.

At this point, rotation of the reel B in the unwinding station 13 can continue, so as to start delivery along the delivery path E of the web material wound on the second reel B formed around the second winding spindle A2.

The process described above can take place at an unwinding speed lower than the normal operating speed.

The first winding spindle A1 located in the removal position PR may still contain a certain quantity of wound web material. This residue can be eliminated by an operator who has easy access to the first winding spindle A1 in removal position PR from the walkway 75. Once the residual web material has been removed from the first winding spindle A1, the hooks 55 can rotate once again according to the arrow f55 (FIG. 6), arranging the first winding spindle A1 in the correct position to be picked up by the bridge crane (not shown) and transferred once again, for example to a winder that forms a new reel therearound. As the exhausted winding spindle A1 is in the removal position, while a new reel B is already being processed and is delivering web material to the line downstream, the cleaning operation of the spindle A1 can take place in the background, i.e. without requiring to stop the new reel during the time required for the cleaning operation. Also the operation of hooking the winding spindle A1 to be removed to the bridge crane takes place in the background, i.e. while a new reel B is already being processed. All this increases the productivity of the processing line of the web material provided with the unwinder described.

Figures 6, 6A:
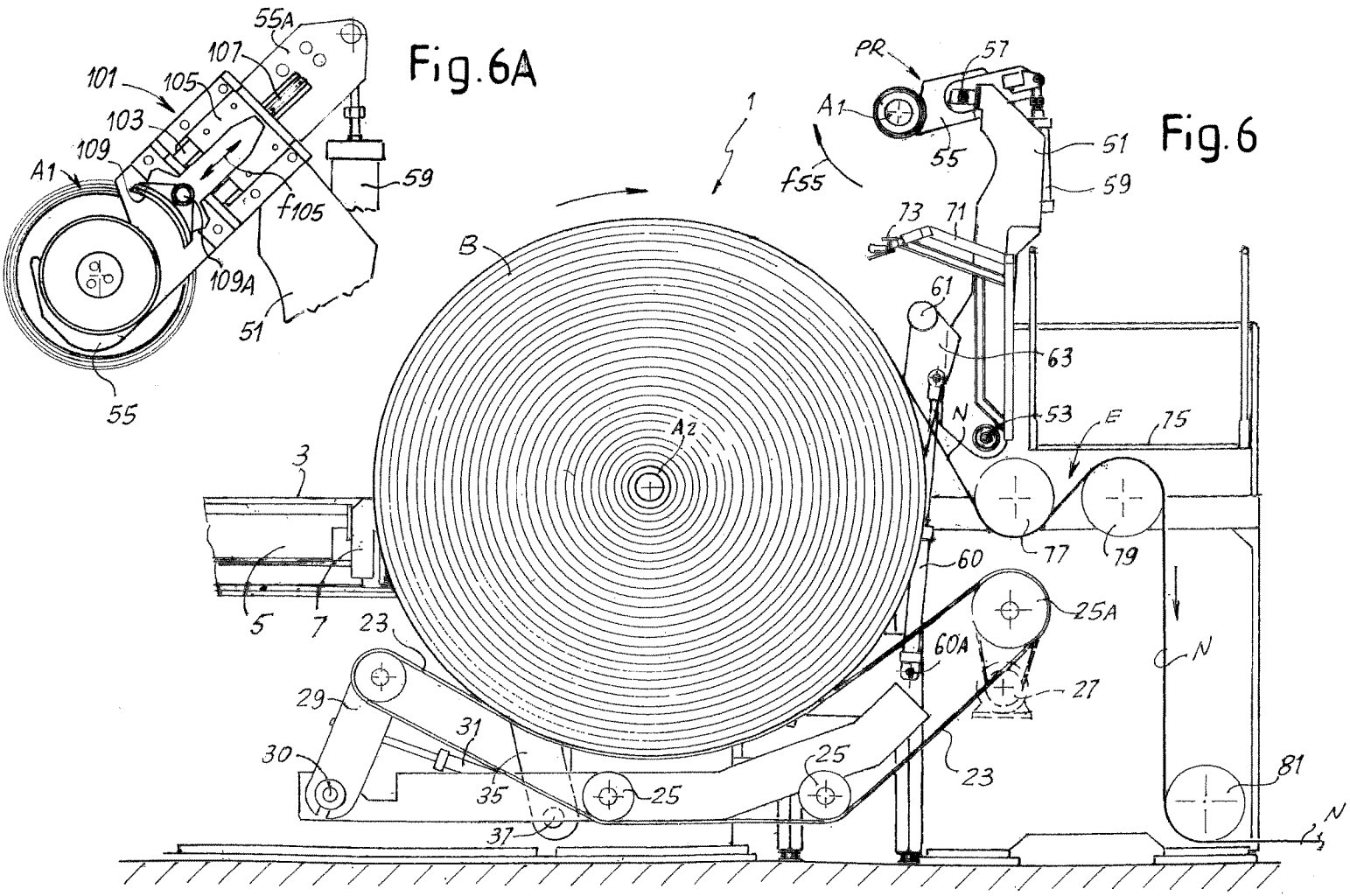
FIG. 6 is a view showing the main elements of the unwinder and yet another part of an operating sequence to change the exhausted reel with the new reel.
FIG. 6A is an enlarged view of a detail of FIG. 6.

In some embodiments, for improved control of the changeover step of the exhausted reel on the spindle A1 with the new reel B, a braking system of the spindle engaged by the hooks 55 can be provided. FIG. 6A shows an enlargement of one of the hooks 55 provided with the braking system, indicated as a whole with 101. A similar system can be provided on the other hook. In the embodiment illustrated the hook 55 carries a pair of guides 103, sliding along which is a slide 105, whose movement according to the double arrow f105 can be controlled by a piston-cylinder actuator 107. A brake block 109 is mounted on the slide 105. Preferably the brake block 109 is floating around an axis 109A. By moving the slide 105 against the spindle A1 the brake block 109 presses against one end of the spindle A1, braking it. This braking effect is used above all during the unwinding step of the spindle A1 in the changeover phase described above, to maintain sufficient tension of the web material N unwound from the reel in the final stage of unwinding.

Figure 9:
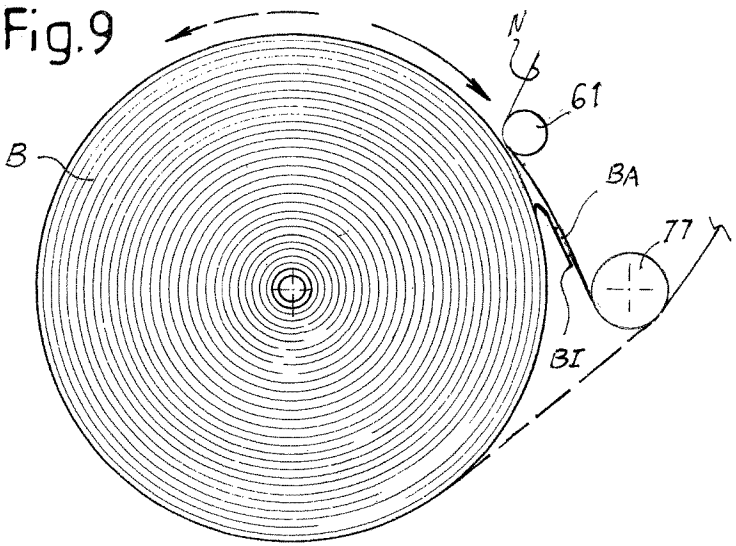
FIG. 9 is a schematic view showing the operation of the same unwinder with reels wound in the direction opposite that shown in the sequences of FIGS. 1 to 6.
Figure 8:
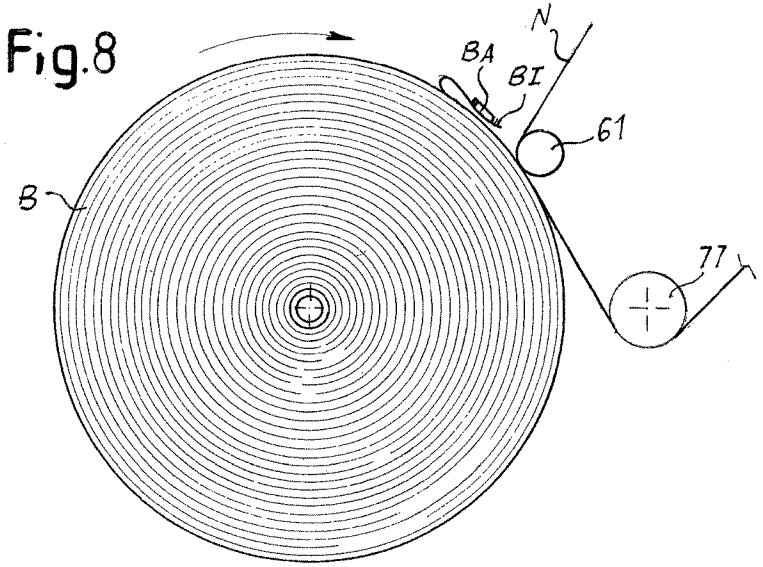
FIG. 8 is a schematic view showing an operation of the same unwinder with reels wound in a direction opposite that shown in the sequences of FIGS. 1 to 6.

In the embodiment described above the reel B that is inserted into the unwinding station 13 must rotate clockwise (in the drawing) to deliver the web material wound thereon. The same mechanical structure can also be used to unwind reels wound in the opposite direction and which therefore are unwound by counterclockwise rotation (in the drawing). For this purpose it is sufficient for the double-sided adhesive tape BA applied in proximity of the leading edge BI of the web material of the reel B to be arranged on the surface normally facing the inside of the same web material. FIGS. 8 and 9 schematically show the procedure of adhesion of the final section of the web material N wound on the winding spindle A1 to the initial part of the web material of the reel B in this case. In the FIG. 8 the reel B starts to rotate in the direction opposite to the unwinding direction until (FIG. 9) the overturned leading edge with the double-sided adhesive tape BA is carried under the web material N coming from the first winding spindle A1 located in the removal position PR. The reel B can be stopped, the web material N along the section between the pressing member 61 and the first winding spindle A1 can be severed and the reel B can start to rotate in the unwinding direction, therefore reversing the rotating motion, as represented schematically by the two arrows in FIG. 9.

By arranging double-sided adhesive tape BA on the inner surface of the leading edge of the web material optimal tensile stress is obtained in the splicing area of the two web materials coming from the first winding spindle A1 and from the second reel B, preventing the occurrence of stresses that tend to detach the two web materials. In some cases, depending upon the type of double-sided adhesive used and/or of the type of web material, the double-sided adhesive tape BA could be applied to the external surface of the leading edge of the reel B.

Figure 10:
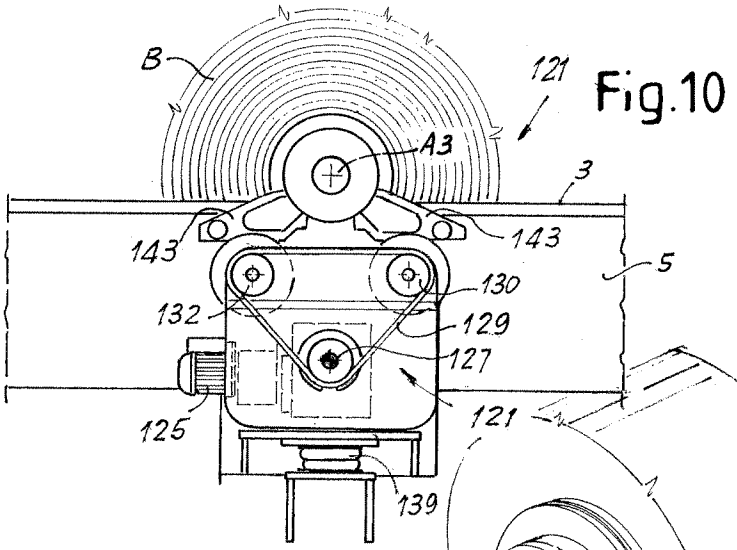
FIG. 10 is a schematic side view of a preparation and standby station.

In the preceding figures the positioning and standby station is omitted for clarity of the drawing. This positioning and standby station is located along the rails 3 sideways of the unwinding station 13. FIG. 10 shows the extension of the rails 3 and the positioning and standby station, indicated with 121. A reel B wound around a winding spindle A3 is schematically shown in the positioning and standby station 121.

Figure 11:
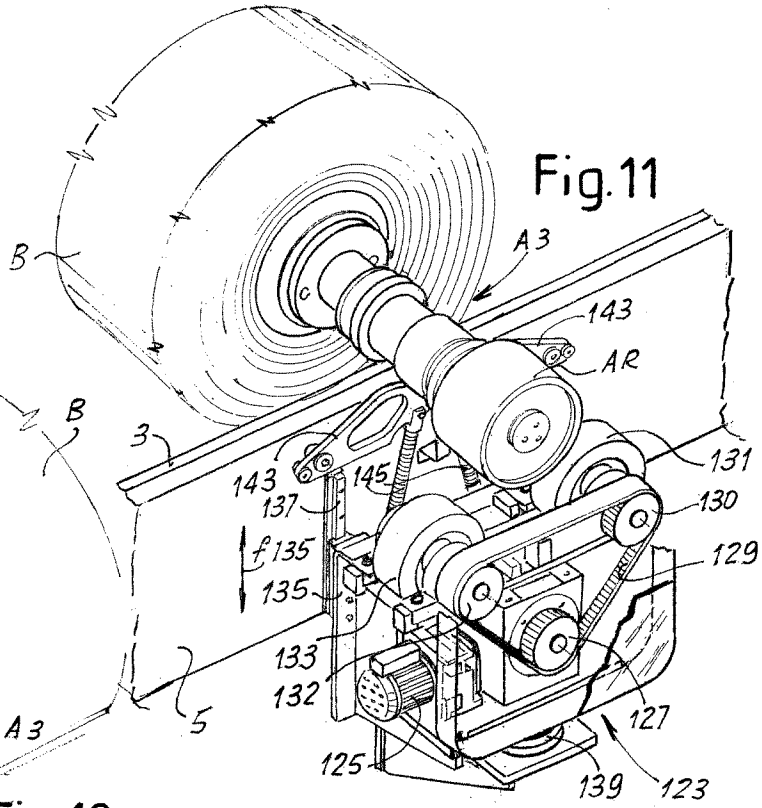
FIG. 11 is an enlarged view of the system for slow rotation and angular positioning of the reel in the preparation and standby station.
Figure 12:
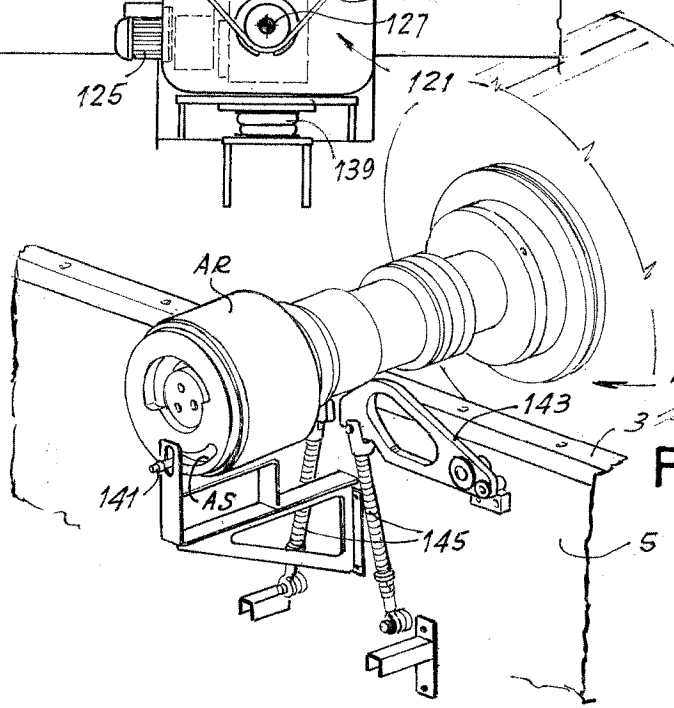
FIG. 12 is an enlarged view of the system for angular positioning of the reel in the preparation and standby station.

FIGS. 11 and 12 show details of the positioning and standby station 121 and more in particular illustrate two opposite side members of the station.

FIG. 11 shows an enlargement of the side member of the positioning and standby station 121 illustrated in FIG. 10. A unit for slow rotation of the reels B, labeled 123 as a whole, is arranged on this side member. The unit for slow rotation 123 comprises a gear motor 125, the output shaft of which is fitted with a pulley 127, around which a belt 129 is guided. The belt 129 is guided around further pulleys 130 and 132, torsionally constrained to friction wheels 131 and 133. The friction wheels 131 and 133 are then rotated by the gear motor 125 for the purposes described below. The members of the unit for slow rotation 123 described above are carried by a slide 135 movable according to the arrow f135 along guides 137. An actuator, for example a pneumatic actuator, such as a piston-cylinder or a torpress, indicated schematically with 139, pushes the slide 135 upward, carrying the wheels 131, 133 into contact with a roller AV with which the winding spindle is provided. The thrust exerted by the actuator 139 is sufficient to generate friction between the roller AV and the wheels 131, 133 to slowly rotate the winding spindle A3, with the reel B formed around it, by means of the motor 125.

This rotation is activated when the reel B must remain standing-by in the positioning and standby station, so as to prevent out-of-roundness deformation of the reel.

Rotation of the reel is also used as an aid for the operator who has to prepare the reel. Preparation consists in severing the web material, forming a leading edge in a specific angular position of the reel, as described below, fixing the leading edge BI to the cylindrical surface of the reel, for example with one or more pieces of adhesive tape, and applying one or more pieces of double-sided adhesive tape BA in the correct angular position.

The angular position of the leading edge BI and therefore of the double-sided adhesive tape BI must be correctly identified by the machine and maintained when the reel is transferred to the unwinding station 13. For this purpose, the winding spindle, for example the spindle A3 of the reel B located in the positioning and standby station 121, is provided with an angular reference that can be read by a sensor 141 placed in the positioning and standby station. In the example illustrated, the sensor 141 is located on the side member opposite the one on which the unit for slow rotation 123 is located and is shown in FIG. 12. The sensor 141 is able to detect the position of a slot AS formed on the end of the winding spindle A3 located in the positioning and standby station 121.

Preparation of the reel B therefore takes place as follows. Once the reel B is located in the positioning and standby station 121, the operator activates the unit for slow rotation 121, which rotates the reel B by means of the winding spindle A3. Once the sensor 141 has detected the slot AS, for example the end of the slot, rotation is stopped. The operator severs the outermost turn of the web material of the reel B, forming a leading edge BI in a predefined angular position along the circumferential extension of the reel. This position is subsequently found again and maintained by means of the sensor 141. The leading edge BI thus formed is fixed to the outer surface of the reel B by means of suitable means, for example pieces of adhesive tape with a light glue. Subsequently, the operator applies sufficient double-sided adhesive tape in a predetermined position with respect to the leading edge BI.

At this point, preparation of the reel is finished. If it is not yet time to replace the reel located in the unwinding station 13 of the unwinder 1, the reel located in the positioning and standby station is rotated slowly by means of the unit for slow rotation 123. When the replacement cycle of the exhausted reel must be started up, the gear motor 125 performs a deceleration step until the reel B stops. By means of the sensor 141 the reel is stopped in substantially the same position it was in when the double-sided adhesive tape was applied. At this point, the reel can therefore be transferred by means of the carriages 7 and the arms 35 in the unwinding station 13. Due to the way in which the carriages and the arms are structured, the angular position of the reel is maintained, transferring it without rotation, so that it is located in the unwinding station 13 with the leading edge BI and the double-sided adhesive tape BA in the correct angular position.

Elastic reel retaining means can be provided on the two side members of the positioning and standby station 123. In the embodiment illustrated, the retaining means comprise, on each side member, pivoting arms 143 arranged in symmetric pairs and shaped to form, on each side member, a retaining saddle of the winding spindle A3 of the reel B temporarily located in the positioning and standby station. Elastic members 145 thrust the arms toward the axis of the reel so as to hold it in position. When the carriages 7 start to move the reel along the rails 3, the arms 143 are lowered, overcoming the elastic force of the elastic members 145, allowing passage of the reel and movement thereof to the unwinding station 13. This passage can be facilitated by lifting the spindle slightly by means of lifting the cradles 9 which, for this purpose, can be provided with respective actuators 9A.

While specific embodiments of the invention have been shown and described in detail to illustrate the application of the principles of the invention, it will be understood that the invention may be embodied otherwise without departing from such principles.

What is claimed is:

1. An unwinder of reels of web material wound around winding spindles, comprising:

an unwinding station with at least one unwinding member to rotate a reel that is located in said unwinding station and feed the web material toward a delivery path;

lifting members to lift a spindle of a first exhausted reel from said unwinding station in a removal position;

an insertion member to insert a second reel into said unwinding station;

a pressing member to press the web material coming from the first reel in the removal position against the second reel in the unwinding station; and a severing member arranged and controlled to sever the web material of said first reel in an area comprised between the removal position and said pressing member, wherein said pressing member is arranged and controlled to press the web material of the first reel against a lateral surface of the second reel so as: to generate friction between the lateral surface of the second reel and the web material, such that rotation of the second reel and a pressure exerted by the pressing member causes the first reel to be drawn into rotation and to deliver by pulling the web material remaining around the first reel, such that a residual web material is drawn from the first reel; and to provide pressure to cause adhesion of the web material of the first reel to the web material of the second reel, by means of a double-sided adhesive tape interposed between the two web materials, wherein a braking system is associated with said lifting members to brake the spindle of said first reel located in the removal position.

2. An unwinder as claimed in claim 1, wherein said severing member is supported by a support projecting toward the reel in the unwinding station and a first actuator is provided, which controls a movement to activate the severing member with respect to said support.

3. An unwinder as claimed in claim 2, wherein said severing member is provided with a pivoting activation movement, which carries the severing member to interfere with a trajectory of the web material.

4. An unwinder as claimed in claim 2, wherein said lifting members are operated by at least one second actuator and said lifting members are pivoting arms.

5. An unwinder as claimed in claim 4, further comprising: at least one third actuator to control said pressing member.

6. An unwinder as claimed in claim 5, wherein said lifting members comprise pick-up hooks to engage the spindle of the first reel in the unwinding station and lift the first reel into said removal position, said hooks being movable with respect to the lifting members to facilitate pick-up of the spindle in the unwinding station, severing of the web material and transfer of the spindle from the lifting members to transfer members.

7. An unwinder as claimed in claim 6, further comprising: at least one fourth actuator to control a relative movement of the pick-up hooks with respect to the lifting members.

8. An unwinder as claimed in claim 7, further comprising: an insertion member controlled by at least one fifth actuator to insert reels into the unwinding station.

9. An unwinder as claimed in claim 8, wherein said insertion member is provided with a pivoting movement and said insertion member comprises pick-up elements to engage an end of a winding spindle projecting from the reel.

10. An unwinder as claimed in claim 8, wherein said insertion member is associated with rails for transferring the winding spindles, said reels extending from a standby area of the reel to be unwound toward the unwinding station.

11. An unwinder as claimed in claim 10, wherein the rails are associated with support surfaces movable parallel to an axis of the reel in the unwinding station, said support surfaces extending between the rails and the unwinding station.

12. An unwinder as claimed in claim 6, wherein said pick-up hooks are provided with a pivoting movement with respect to the lifting members.

13. An unwinder as claimed in claim 1, wherein said lifting members are provided with a rotating or pivoting movement to lift spindles of the unwinding station.

14. An unwinder as claimed in claim 1, wherein said pressing member is supported by pivoting arms to be carried alternately from a withdrawn position with respect to a trajectory of the web material between the removal position and the unwinding position, to a position of pressing the web material coming from the removal position against a surface of the second reel in the unwinding station.

15. An unwinder as claimed in claim 1, wherein retaining members for retaining the second reel being unwound are provided in said unwinding station.

16. An unwinder as claimed in claim 1, wherein said pressing member comprises an idle roller.

17. An unwinder as claimed in claim 1, further comprising:

an access walkway arranged so as to allow an operator access to a winding spindle in the removal position along an entire length of said winding spindle.

18. An unwinder of reels of web material wound around winding spindles, the unwinder comprising:

an unwinding station with at least one unwinding member to rotate a reel that is located in said unwinding station and feed the web material toward a delivery path;

lifting members to lift a spindle of a first exhausted reel from said unwinding station in a removal position;

an insertion member to insert a second reel into said unwinding station;

a pressing member to press the web material coming from the first reel in the removal position against the second reel in the unwinding station; and a severing member arranged and controlled to sever the web material of said first reel in an area comprised between the removal position and said pressing member, wherein said pressing member is arranged and controlled to press the web material of the first reel against a lateral surface of the second reel so as: to generate friction between the lateral surface of the second reel and the web material, such that rotation of the second reel and a pressure exerted by the pressing member causes the first reel to be drawn into rotation and to deliver by pulling the web material remaining around the first reel, such that a residual web material is drawn from the first reel; and to provide pressure to cause adhesion of the web material of the first reel to the web material of the second reel, by means of a double-sided adhesive tape interposed between the two web materials;

a positioning and standby area of reels to be unwound, in which members for rotation for angular positioning of the reels standing by, and a device for angular positioning, are provided, wherein a unit for slow rotation of the reel standing by is arranged in said positioning and standby area.

19. An unwinder as claimed in claim 18, further comprising:

members to transfer a reel from the positioning and standby area to the unwinding station by translation without rotation, so as not to modify an angular position of the reel.

20. A method for replacing a first reel in a final stage of unwinding with a second reel in an unwinder of reels of web material wound around winding spindles, the method comprising the steps of:

interrupting or slowing down unwinding of a first reel located in an unwinding station;

lifting the first reel in the final stage of unwinding and a respective winding spindle from the unwinding station in a removal position, forming a portion of web material between the first reel in the removal position and a delivery path;

inserting a second reel in the unwinding station;

pressing the web material of the first reel against an outer surface of the second reel via a pressing member during a rotation step of the second reel;

starting rotation of the second reel and generating a pulling force on the web material of the first reel by friction between the web material of the first reel and the outer surface of the second reel while the first reel is braked, so as to unwind by pulling the web material of the first reel located in the removal position until said web material adheres to the leading edge of the second reel;

interrupting with a severing member the web material between the first reel located in the removal position and a point of adhesion to a leading edge of the second reel.

21. A method as claimed in claim 20, wherein said second reel has a leading edge of web material to which a double-sided adhesive material is applied.

* * * * *